United States Patent [19]

Stenz et al.

[11] Patent Number: 5,041,704

[45] Date of Patent: Aug. 20, 1991

[54] DUAL DISCONNECT TERMINAL ASSEMBLY AND SWITCH

[75] Inventors: Paul Stenz; Horst Conrad; Georg Hille, all of Detmold; Gerhard Huiskamp, Lage, all of Fed. Rep. of Germany

[73] Assignee: C.A. Weidmüller GmbH & Co., Fed. Rep. of Germany

[21] Appl. No.: 471,480

[22] Filed: Jan. 29, 1990

[30] Foreign Application Priority Data

Mar. 4, 1989 [EP] European Pat. Off. ..... 89103812.7

[51] Int. Cl.[5] ..... H01H 21/54; H01R 19/00

[52] U.S. Cl. ..... 200/6 R; 200/15

[58] Field of Search ..... 200/6 R, 6 C, 11 R, 200/11 B, 11 G, 11 TC, 15, 51 R, 51.02-51.04, 252, 253.1, 254, 260, 339, 560, 562, 563; 361/356, 360, 363, 368; 324/73.1, 74

[56] References Cited

U.S. PATENT DOCUMENTS 4,328,401 5/1982 Carr ..... 200/252 X

FOREIGN PATENT DOCUMENTS 1115804 4/1962 Fed. Rep. of Germany .
2357080 1/1978 France .

*Primary Examiner*—J. R. Scott
*Attorney, Agent, or Firm*—Laubscher, Presta & Laubscher

[57] ABSTRACT

In a dual disconnect terminal assembly including a switch, the disconnect contact member for opening and closing the current paths formed by bus bar segments in the upper and lower terminal tiers is a toggle lever which includes contact bridges for each respective tier. The lever can be pivoted into three different switch positions. In a first position, the upper and lower contact bridges are connected with the bus bar segments of the upper and lower tiers, respectively, to close the current paths therebetween. In a second position, the upper and lower contact bridges are spaced from the bus bar segments of the upper and lower tiers, respectively, to open the current paths therebetween. In a third position, the upper contact bridges are connected with extensions of the bus bar segments of the upper tier to close the current path thereof and the lower contact bridges are spaced from the bus bar segments of the lower tier to open the current path thereof.

11 Claims, 2 Drawing Sheets

FIG. 1
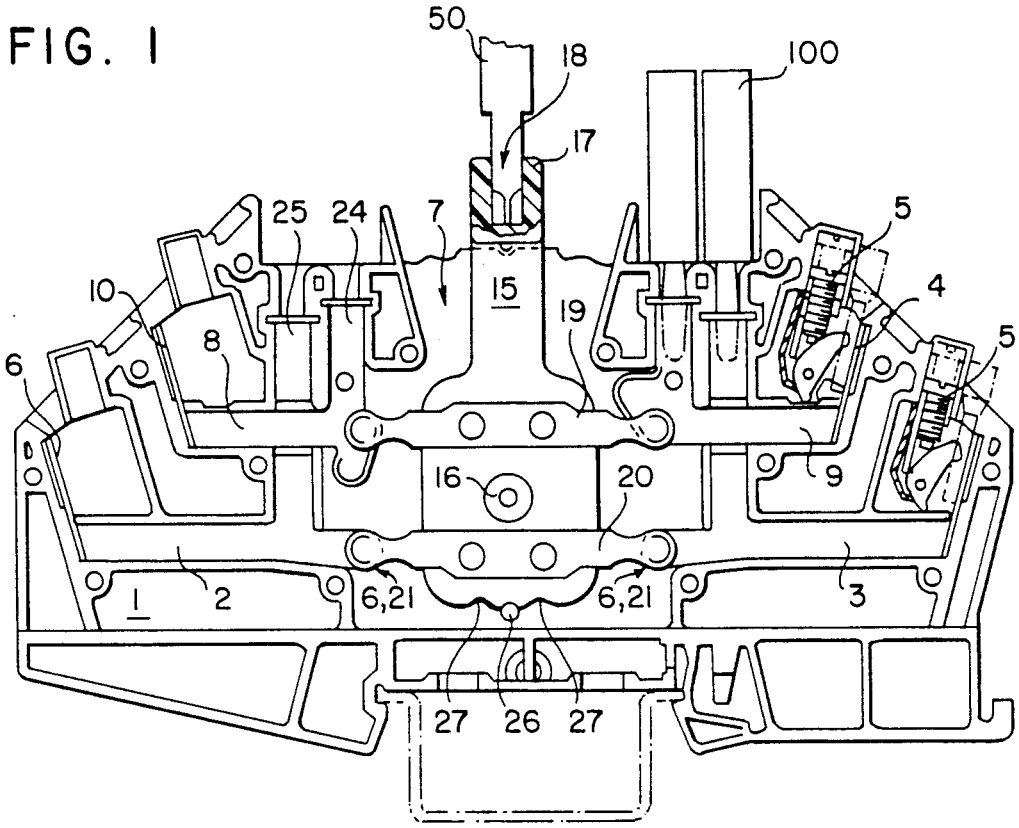
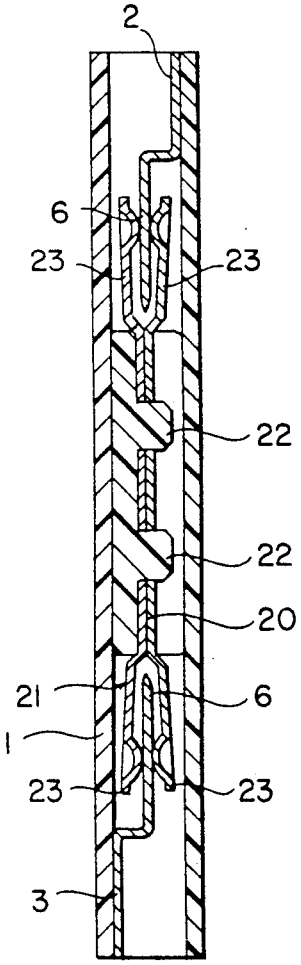
FIG. 4

DUAL DISCONNECT TERMINAL ASSEMBLY AND SWITCH

BACKGROUND OF THE BACKGROUND

The present invention relates to a dual disconnect terminal assembly including a switch mechanism having two tiers of bus bar segments and connectors for connecting external electrical conductors with the bus bars. The bus bar segments have opposed ends arranged within a switching region of a terminal housing. The opposed ends define contact regions. A disconnect contact member is movably arranged within the housing and includes contact bridges for opening and closing the current paths of each tier of bus bars in accordance with the position of the disconnect member.

BRIEF DESCRIPTION OF THE PRIOR ART

Dual disconnect terminals are known in the art as evidenced by the French patent No. 2,357,080. This patent discloses a disconnecting contact member in the form of a reciprocating slider having a handle which projects from the top of the terminal housing. The contact bridges on the slider are arranged in such a manner relative to the contact regions of the two tiers of bus bar segments that when the slider is in a first position the bus bar segments of one tier are connected by a contact bridge for closing the current path of the first tier bus bar while the current path in the second tier bus bar is left open. When the slider is in a second position, the reverse is true with respect to the open and closed conditions of the current paths of the two tiers of bus bars.

A major drawback of the prior slider type disconnect terminals as disclosed in the French patent is that it is difficult to visually determine the switch position of the slider which makes the terminal unreliable. Due to the translatory switching motion and the relatively short travel of the contact slider relative to the housing between the two positions, it is difficult to visually ascertain the position of the slider switch. Bearing in mind that in a switching assembly a plurality of disconnect terminals are arranged side-by side on carrier rails or the like, it is evident that one must be able to readily visually observe the position or condition of each switch. A second drawback of the prior slider type dual disconnect terminals is that the wiring options of the two tiers of bus bars are relatively low. Frequently, it is desirable from a functional standpoint to have more wiring options. However, with conventional slider type terminals, it is impractical to provide three-position sliders since this further compounds the problem of visually determining the switching condition of the terminal.

Also known in the art are disconnect terminals with only one current path as shown for example in DE 1,115,804 wherein the disconnecting contact member comprises a toggle lever rotatable within the terminal housing between on and off positions closing and opening the single current path, respectively. The two positions of the toggle lever are readily visible since the handle of the toggle lever projects from the top of the housing. The major drawback of the prior toggle lever disconnect terminals is that with only one current path, the wiring options are severely limited.

The present invention was developed in order to overcome these and other drawbacks of the prior devices by providing a dual disconnect terminal assembly and switch having two bus bar current paths and which provides a larger number of switching combinations with a single contact member and at the same time affords a visual indication of the switching position of the contact member having more than two switching positions.

SUMMARY OF THE INVENTION

Accordingly, it is a primary object of the present invention to provide a dual disconnect terminal assembly and switch including a housing and first and second bus bars mounted in the housing, each including a pair of segments terminating in contact regions. The contact regions of the first bus bar segments have extensions. A switch mechanism is provided for selectively connecting the segments of the first and second bus bars, respectively. The switch mechanism includes a toggle lever pivotally connected with the housing within a switching region between the contact regions of the first and second bus bar segments. The lever is rotatable between three switching positions. First and second contact bridges are connected with the toggle lever for opening and closing current paths of the first and second bus bars, respectively, in accordance with the position of the toggle lever. When the toggle lever is in a first position, the first and second contact bridges are connected with the contact regions of the first and second bus bar segments to close the current paths of the first and second bus bars. When the toggle lever is in a second position, the first and second contact bridges are spaced from the contact regions of the first and second bus bar segments to open the current paths of the first and second bus bars. When the toggle lever is in a third position, the first contact bridge is connected with the contact extensions of the first bus bar segments to close the current path of the first bus bar and the second contact bridge is spaced from the contact regions of the second bus bar segments to open the current path of the second bus bar.

The toggle lever includes a handle which projects from the housing. As the toggle lever is rotated among the three positions, the handle traverses a large arc so that each of the three different switch positions can be easily discerned by visual inspection, even when a plurality of the terminals are arranged in a row along a carrier rail.

According to another object of the invention, a locking assembly is provided to lock the toggle lever into each of its three positions.

A further object of the invention is to provide spring contacts on the contact bridges to improve the connection between the contact bridges and the contact portions of the bus bar segments.

According to yet another object of the invention, the first and second contact bridges are arranged on opposite sides of the rotational axis of the lever, thereby reducing the overall height of the terminal.

The bus bar segments also include upright cross leg portions for receiving test plugs.

BRIEF DESCRIPTION OF THE FIGURES

Other objects and advantages of the invention will become apparent from a study of the following specification when viewed in the light of the accompanying drawing, in which:

FIG. 1 is a side view of the dual disconnect terminal assembly including a switch according to the invention with one side of the housing open and with the disconnecting contact toggle lever in a first position closing the contact paths of both bus bars;

FIG. 4 is a partial top sectional view of the switching region of the terminal assembly of FIG. 1 showing a contact bridge of the disconnecting contact toggle lever.

DETAILED DESCRIPTION

Figure 2:
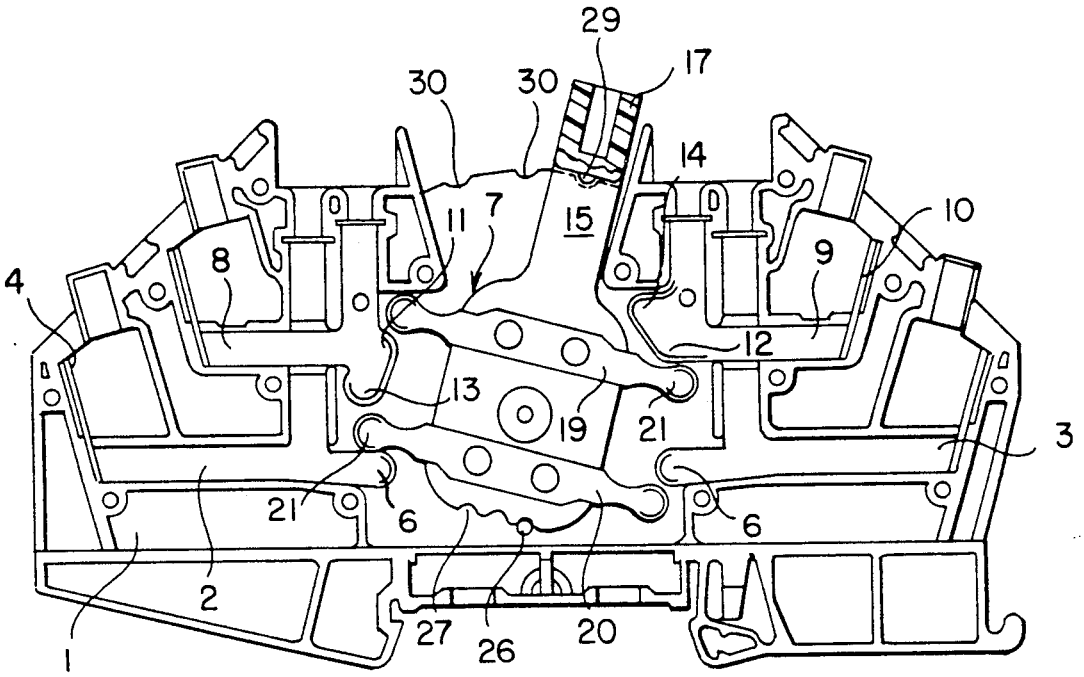
FIG. 2 is a side view of the terminal assembly of FIG. 1 with one side of the housing open and with the toggle lever in a second position opening the contact paths of both bus bars.

The dual disconnect terminal assembly and switch of the invention is shown in FIG. 1 and has a housing 1 made of an electrically insulating synthetic plastic material in which bus bar segments 2 and 3 are embedded, as seen from the open side, in a bottom tier. The bus bar segments 2 and 3 are parts of the current path of the bottom tier. At their external ends, the bus bar segments 2 and 3 have deflected contact tabs 4, against which incoming electrical conductors on one side and outgoing electrical conductors on the other side can be clamped by connectors such as conventional screw connectors 5 which are also embedded in the terminal housing 1. For simplicity, only the connectors on the right side corresponding to the bottom tier and the upper tier, for clamping the electrical conductors to the contact tabs 4 are shown in FIG. 1. On the left side, the two tiers have corresponding components with screw connectors as well.

At their opposite internal ends, the bus bar segments 2 and 3 of the bottom tier form the contact regions 6 which comprise rounded off ends of these bus bar segments in the illustrated embodiment. These contact regions 6 of the bus bar segments 2 and 3 project into a switching region 7 formed in the center of the terminal housing 1.

In the upper tier of the dual disconnect terminal housing are embedded in a similar manner the bus bar segments 8 and 9, which on their outer ends have deflected contact tabs 10 in order to interact with the connectors 5 to connect the electrical conductors and which on their opposing internal ends have contact regions 11 and 12. The upper bus bar contact regions 11, 12 have extensions 13, 14 which form a further switch position as will be set forth in greater detail below. These contact regions 11 and 12 of the bus bar segments 8 and 9 in the upper tier also extend into the switching region 7. The bus bar segments 8 and 9 in the upper tier are part of the upper current path of the dual disconnect terminal assembly.

A disconnecting contact member comprising toggle lever 15 is pivotally mounted on a pin 16 on the closed side wall of the terminal housing 1 in the switching region 7. The toggle lever 15 has on its upper end a handle 17 projecting from the terminal housing 1 at the top. The handle contains a plug bore 18 in which a screw driver 50 (shown in FIG. 1) can be inserted, for example, to actuate the toggle lever 15 between three different possible switch positions as will be discussed below.

The toggle lever 15 includes two contact bridges 19, 20 which are adapted to bridge or connect the segments of the upper and lower bus bars, respectively. Each contact bridge includes a contact region 21 at the end thereof adapted for connection with or release from the contact regions 6, 11, 12 of the bus bar segments 2, 3, 8, 9, depending upon the position of the toggle lever.

As set forth above, the toggle lever 15 has three different switch positions with corresponding different wiring functions of the current paths in the upper and lower tiers of bus bars. In the first or center position of the lever 15, shown in FIG. 1, the contact bridges 19 and 20 are essentially parallel to the bus bar segments in the upper and lower tier. The contact regions 21 of the lower contact bridge 20 make contact with the contact regions 6 of the bus bar segments 2 and 3 of the lower tier. The contact regions 21 of the upper contact bridge 19 make contact with a part lying in the extension of the bus bar segments 8 and 9 of the upper tier and belonging to the contact regions 11, 12 of these bus bar segments. Thus, in this switch position of the toggle lever 15, both the upper and the lower current paths are closed.

In the second switch position of the toggle lever 15, shown in FIG. 2 in which the handle of the toggle lever is pivoted to the right, all contact regions 21 of both contact bridges 19 and 20 are spaced from the contact regions 6, 11 and 10 of the lower bus bar segments 2 and 3 and of the upper bus bars segments 8 and 9. Thus, in this switch position the current paths in the upper and bottom tiers are both interrupted and thus opened.

Figure 3:
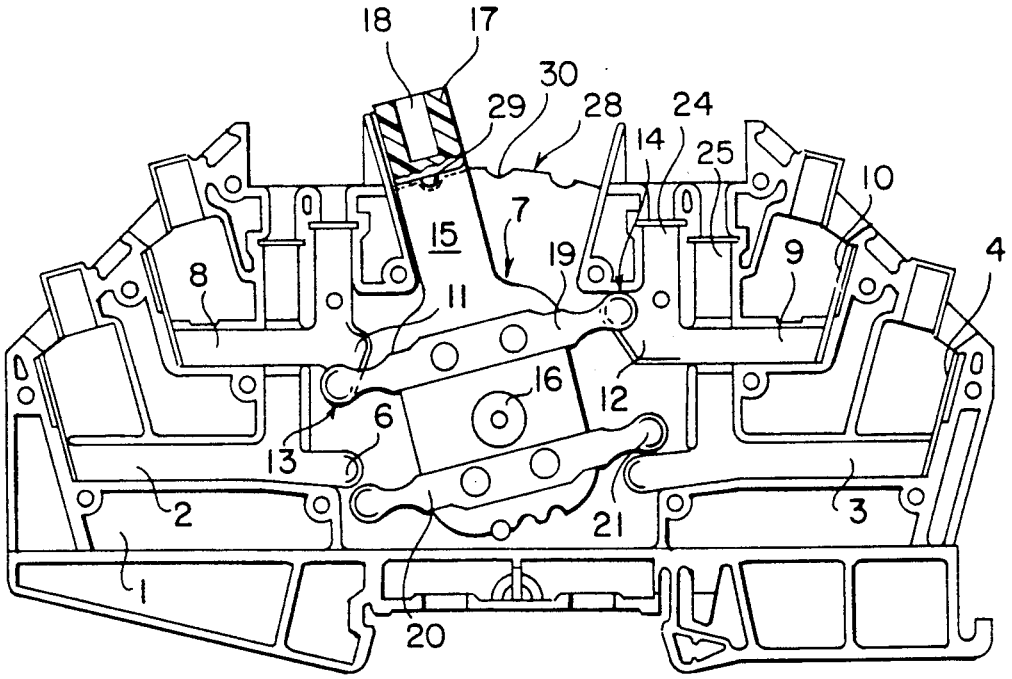
FIG. 3 is a side view of the terminal assembly of FIG. 1 with one side of the housing open and with the toggle lever in a third position closing the contact path of the upper bus bar and opening the contact path of the lower bus bar.

In the third switch position of the toggle lever 15 shown in FIG. 3 in which the manipulating region of the toggle lever 15 is pivoted to the left, the contact regions 21 of the bottom contact bridge 20 have been swung out of the contact regions 6 of the lower bus bar segments 2 and 3. The lower current path is thus opened. In the upper tier, however, the contact regions 21 of the upper contacts 10 still make contact with the contact regions 11 and 12 of the upper bus bar segments 8 and 9, and in particular in the region which is formed by the extensions 13 and 14.

Therefore, in accordance with the pivoting movement of the upper contact bridges 19 together with the toggle lever 15 to the third switch position, the extension 13 of the bus bar segment 11 is oriented downwardly, whereas the extension 14 of the bus bar segment 12 is oriented upwardly. Thus, in this switch position of the toggle lever 15 the lower current path is open, whereas the upper current path is closed.

It is self-evident that the extension of the contact regions of the bus bar segments could also be carried out in the lower tier, instead of in the upper tier. In such a case the lower current path would still be closed in a comparable position of the toggle lever when the current path is open.

In the preferred construction, the contact bridges 19 and 20 are fastened onto fastening pins 22 on the toggle lever 15 made of an electrically insulating material. As shown in FIG. 4, the contact bridges 19, 20 are preferably designed as a double layer, for example by folding a one-piece blank of brass or bronze sheet metal in its longitudinal direction so that the contact regions 21 of the contact bridges 19 and 20 are designed as spring contacts 23, which can accomodate between them in a flexible manner the small flag like contact regions 6, 11, and 12 of the bus bar segments 2, 3, 8, and 9 in the closed position. This provides a very reliable friction-locked contact by means of a clearly defined and specified spring force. This contact force which is determined by the spring force is also not transferred or absorbed by the insulating material.

The upper contact bridge 19 and the lower contact bridge 20 relative to the pivot point of the toggle lever 15 on the pin 16 are arranged with different spacing. That is, the distance of the lower contact bridge 20 to the axis of the rotation is shorter than that of the upper contact bridge 19. In consideration of the pivot paths in the sense of opening and closing the current paths, this leads to a space-saving, relatively low total height.

As shown in the drawing, the bus bar segments 2, 3, 8 and 9 are arranged upright in the terminal housing 1. This provides quasi automatic flag-like contact regions 6, 11, 12 to interact with the overreaching spring contacts 23 in the contact region 21 of the contact bridges 19 and 20. Furthermore, it is necessary in the contact of the normal operating mode of disconnect terminals that the bus bar segments 2 and 3 and 8 and 9 all have their possible connection for a test plug. In this context the bus bar segments 8 and 9 of the upper tier have upwardly extending cross legs 24, whereas the bus bar segments 2 and 3 of the lower tier have upwardly extending cross legs 25, which in the crossing zone with the upper bus bar segments 8 and 9 are electrically insulated therefrom. The upper ends of the cross legs 24 and 25 are all bent down and in this deflection are provided in such a manner with a plug opening that a test plug 100 can be plugged in for test purposes, as shown in FIG. 1.

A comparison of the views for FIGS. 1, 2, and 3 shows that the three different switch positions of the toggle lever 15 can be visually discerned readily and reliably from the outside by inspection of the position of the handle 17 that is connected to the lever. This is particularly true where a number of such dual disconnect terminal assemblies are arranged side by side in the context of a switchgear assembly. In order to be able to choose readily and by touch these three different switch positions and in order to ensure that the toggle lever 15 is in the respective position and to prevent against unintentional pivoting out of the selected switch position, locking mechanisms are assigned to the switch positions. A locking pin 26, which engages with locking recesses 27 provided in the bottom edge region of the toggle lever corresponding to the three different pivot positions, is molded on the terminal housing 1 on the pivot path of the bottom surface of the toggle lever 15.

A further locking mechanism is provided in the upper region of the terminal housing 1 and the handle portion of the toggle lever 15. To this end, the handle 17 projecting from the housing 1 overreaches the upper edge region 28 of the terminal housing 1 in the area of the switching region 7 and provides a locking pin 29 on the bottom side in the overreaching area of the handle 17. The edge region 28 of the housing, designed in the shape of an arc corresponding to the pivot motion of the handle 17, has three locking recesses 30, which interact with the locking pin 29 of the handle 17 in the corresponding switch positions of the toggle lever 15.

While in accordance with the provisions of the patent statute the preferred forms and embodiments of the invention have been illustrated and described, it will be apparent to those of ordinary skill in the art that various changes or modifications may be made without deviating from the inventive concepts set forth above.

What is claimed is:

1. A dual disconnect terminal and an integral switch device comprising (a) a housing;

(b) first and second bus bars mounted in said housing, each of said bus bars comprising a pair of segments terminating in contact regions, respectively, the contact regions of said pair of first bus bar segments including extensions; and (c) switching means for selectively connecting the segments of said first and second bus bars, respectively, comprising (1) a toggle lever pivotally connected with said housing within a switching region between said contact regions of said first and second bus bar segments, said lever being rotatable about an axis between three switching positions; and (2) first and second contact bridge means connected with said toggle lever for opening and closing the current paths of said first and second bus bars, respectively, in accordance with the position of said toggle lever, whereby when said toggle lever is in a first position, said first and second contact bridge means are connected with the contact regions of said first and second bus bar segments to close the current paths of said first and second bus bars, when said toggle lever is in a second position, said first and second contact bridge means are spaced from the contact regions of said first and second bus bar segments to open the current paths of said first and second bus bars, and when said toggle lever is in a third position, said first contact bridge means are connected with said contact extensions of said pair of first bus bar segments to close the current path of said first bus bar and said second contact bridge means are spaced from the contact regions of said second bus bar segments to open the current path of said second bus bar.

2. A dual disconnect terminal and an integral switch device as defined in claim 1, wherein a portion of said lever extends from said housing and contains a plug bore open at its upper end.

3. A dual disconnect terminal and an integral switch device as defined in claim 1, wherein said contact include spring contacts for connection with said bus bar segment contact regions.

4. A dual disconnect terminal and an integral switch device as defined in claim 3, wherein said contact bridge means are formed of unitary blanks of electrically conductive sheet metal, said blanks being folded longitudinally to define said spring contacts.

5. A dual disconnect terminal and an integral switch device as defined in claim 1, wherein said first and second contact bridge means are parallel and arranged on opposite sides of the axis of rotation of said toggle lever, the distance of said second contact bridge means from said axis being less than the distance of said first contact bridge means from said axis.

6. A dual disconnect terminal and an integral switch device as defined in claim 1, wherein said segments of said first and second bus bars are positioned upright within said housing, said segment contact regions extending into said switching region in the shape of small upright contact tabs.

7. A dual disconnect terminal and an integral switch device as defined in claim 1, wherein said segments of said first and second bus bars include upwardly extending cross leg portions having upper ends designed as test plug connectors.

8. A dual disconnect terminal and an integral switch device as defined in claim 1, wherein said extension of one of said first bus bar segment contact regions extends upwardly and said extension of the other of said first bus bar segment contact regions extends downwardly.

9. A dual disconnect terminal and an integral switch device as defined in claim 1, and further comprising means for locking said toggle lever into one of said three switching positions.

10. A dual disconnect terminal and an integral switch device as defined in claim 9, wherein said toggle lever includes a bottom surface containing three spaced recesses, said locking means including a locking pin connected with said housing adjacent said toggle lever bottom surface, said pin engaging said recesses when said toggle lever is in said first, second, and third positions, respectively.

11. A dual disconnect terminal and an integral switch device as defined in claim 9, wherein said toggle lever includes a handle portion extending from and overreaching a portion of said housing, said handle portion having a bottom surface containing three spaced recesses, said locking means including a locking pin connected with said housing portion adjacent said handle portion bottom surface, said pin engaging said recesess when said toggle lever is in said first, second, and third positions, respectively.

* * * * *